United States Patent [19]

Williams

[11] Patent Number: 4,602,744

[45] Date of Patent: Jul. 29, 1986

[54] METHOD OF CONTROLLING A GRINDING ROLLER MILL

[75] Inventor: Robert M. Williams, Ladue, Mo.

[73] Assignee: Williams Patent Crusher and Pulverizer Company, St. Louis, Mo.

[21] Appl. No.: 745,435

[22] Filed: Jun. 17, 1985

Related U.S. Application Data

[63] Continuation of Ser. No. 530,632, Sep. 2, 1983, abandoned.

[51] Int. Cl.[4] ..... B02C 25/00

[52] U.S. Cl. ..... 241/30

[58] Field of Search ..... 241/18, 19, 24, 27, 241/30, 33, 34, 35, 36

[56] References Cited

U.S. PATENT DOCUMENTS

| | | | |
|---|---|---|---|
| 2,003,985 | 6/1935 | Wallene | 241/34 X |
| 2,439,721 | 4/1948 | Dickey | 241/34 X |
| 4,184,640 | 1/1980 | Williams | 241/34 |
| 4,382,558 | 5/1983 | Svensson | 241/121 X |

*Primary Examiner*—Howard N. Goldberg
*Assistant Examiner*—Joseph M. Gorski
*Attorney, Agent, or Firm*—Gravely, Lieder & Woodruff

[57] ABSTRACT

Roller mill control system for a centrifugally swung roller grinding mill to grind fuel in quantity to exactly match a burner fuel demand, driving the roller mill at a speed which varies as the fourth power of the percentage of burner demand for fuel so as to substantially match the mill grinding capability with variations in the percentage of the burner fuel demand, supplying air through the grinding mill for transporting the ground fuel to the burner at a substantially constant ratio of air to fuel from a minimum air velocity which maintains the ground fuel moving in the air stream, and monitoring the pressure differential across the roller mill between its air supply and outlet for detecting abnormal changes in the differential pressure as a safety net.

4 Claims, 5 Drawing Figures

METHOD OF CONTROLLING A GRINDING ROLLER MILL

This is a continuation of co-pending application Ser. No. 530,632, filed on Sept. 2, 1983, now abandoned.

BACKGROUND OF THE INVENTION

1. Field of the Invention

The present invention is directed to a method for controlling the operation of a roller grinding mill having its output connected to a burner such that a steam flow requirement can be produced at a substantially constant level.

2. Description of the Prior Art

In the past fuel feeders connected to roller mills have been traditionally controlled by measuring the relative pressure differential across the roller mill and using the differential as a target control means for the feeder to the roller mill. It has been the normal way of operating a roller mill in order to control the quantity of fuel in the grinding chamber so the rollers are able to perform efficiently in producing a satisfactory output.

There has been disclosed in the prior Williams U.S. Pat. No. 4,184,640 of Jan. 22, 1980 coal grinding apparatus employing a roller grinding mill for grinding coal to be supplied as the fuel for firing burners. In that arrangement the roller mill and a rotary classifier were connected in series and speed regulated so the mill and classifier could be modulated on an inverse speed relationship to maintain a uniform size of coal particles.

While the apparatus of the foregoing patent operates in a satisfactory manner, when it is desired to develop a substantially constant or nonfluctuating steam flow the technique of maintaining a differential pressure across the mill fails to deliver an output that is coordinated with a uniform steam flow output by the burner. As a result, the steam flow fluctuates in an undependable manner.

A further example of the prior art is found in Dickey U.S. Pat. No. 2,172,317 of Sept. 5, 1939 which has disclosed as bowl mill feed control for quickly varying the mill output in accordance with changes in the vapor pressure generated by the furnace, which vapor pressure affects the increase or decrease in the quantity of carrier air flow from the mill, and that change causes a change in the differential pressure across the orifice in the outlet duct from the classifier for the product reduced in the mill. However, this reference does not change mill speed as the grinding is determined by the spring setting on the rollers, and not by centrifugal response of the grinding rollers to speed.

The problem with these earlier arrangements is that they are based on a technique of relying on a differentl pressure associated with the output of a roller mill or pulverizer which fails to allow a direct fired burner to deliver an even or steady steam flow. A fluctuating steam flow from a burner above or below the demand is undesirable and inefficient.

BRIEF SUMMARY OF THE INVENTION

In its broad aspect the method includes feeding fuel material to the inlet of a centrifugally swung roller grinding mill in such quantities as to exactly match the burner fuel demand, driving the roller grinding mill at a speed which varies as the fourth power of the percentage of burner demand for fuel so as to substantially match the mill grinding capabilities with variations in the percentage of the burner fuel demand, supplying air through the grinding mill for transporting the ground fuel to the burner at a substantially constant ratio of air to fuel from a minimum air velocity which maintains the ground fuel moving in the air stream, monitoring the pressure differential across the roller mill between its air supply and its air transported outlet for detecting abnormal changes in the differential pressure as a safety net.

The invention is embodied in an arrangement of apparatus which follows a method of operating a fuel grinding centrifugally swung roller mill for feeding a burner in the steps of synchronizing the feeder rate to boiler demand, matching the grinding capability of the mill to the burner demand by driving the mill at a speed which varies as the fourth power of the percentage of burner demand for fuel, supplying carrier air for moving the ground fuel as well as supporting combustion in the burner in which the pounds of air to pounds of ground fuel is in a ratio of about 2.7, and monitoring the pressure differential across the mill between the inlet to the mill and the fuel outlet from the spinner separator for the mill, whereby the differential pressure is applied as a safety net for modulating the rate of fuel feed into the mill with notice to the operator when the system needs to be adjusted, either by reducing the feed rate and not satisfying burner demand requirement, but keeping feed rate and grinding capabilities in synchronization, or by maintaining proper feed rate and increasing or decreasing the centrifugal force in the mill speed to bring it into synchronism with feed rate to yield a substantially constant steam flow.

The presently preferred embodiment has a control arrangement which is set forth in more detail in the following description.

BRIEF DESCRIPTION OF THE DRAWINGS

Reference is made to the accompanying drawing views for a better appreciation of the virtues of the invention, wherein.

DETAILED DESCRIPTION OF THE EMBODIMENT

Figure 1:
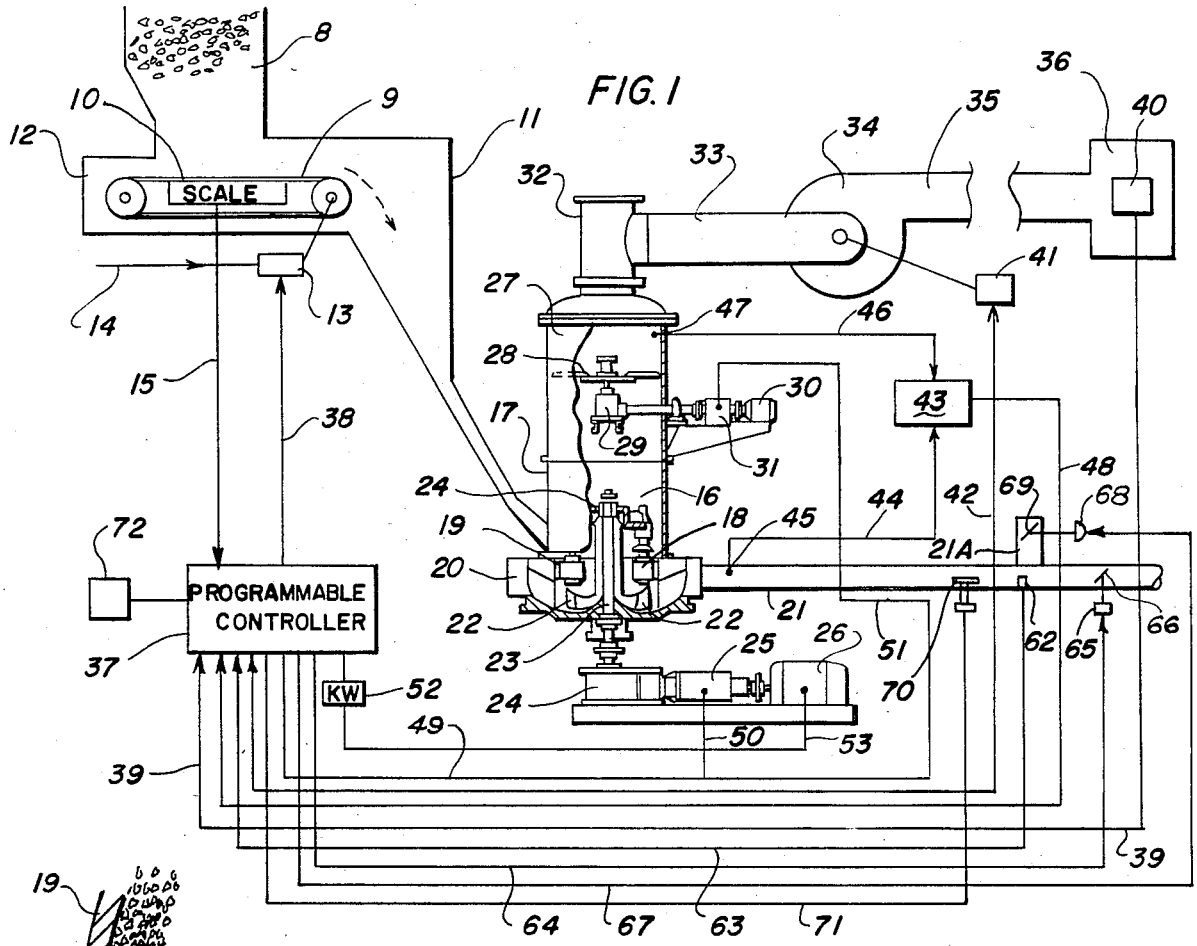
FIG. 1 is a schematic and partial sectional view of apparatus for carrying the present invention into practice.

Turning now to FIG. 1, it can be appreciated that the source of fuel, which may be coal or some other suitable fuel material, is received in hopper 8 so it may be directed onto a conveyor feeder means in the form of a belt 9 which is equipped with a weighing scale 10 for measuring the fuel quantity in unit time which would then be delivered by the belt 9 into the chute 11 which is part of a general housing 12 to confine dust and similar material so that it will not be released to the ambient atmosphere. The conveyor belt 9 is driven by a suitable motor 13 having an electric power source 14, and the weighing scale 10 produces a signal at lead 15 which will be more fully referred to hereinafter. The fuel delivered into the chute 11 enters the grinding chamber 16 of an air swept fluid bed vertical shaft roller mill 17 where it is ground under the influence of centrifugally responsive rollers 18 acting against a bull ring 19. The crushing or grinding chamber 16 of the mill 17 is formed with inlets opening to a wind box 20 having an air inlet 21 for introducing the air into the lower portion of the crushing chamber so that the sweep of the air and the action of plows 22 driven by the vertical shaft 23 from a suitable head assembly 24 will constantly stir and lift the fuel material into the orbit of the rollers 18. The drive mechanism for the vertical shaft 23 includes the gear box 24 having a variable speed clutch 25 disposed between the gear box 24 and the driving motor 26, or by a direct connected variable speed motor.

The ground material is air swept upwardly through the grinding chamber 16 into a spinner separator or classifier 27 which embodies rotating blades 28 operable on a shaft driven through a gear box 29 receiving its driving energy from electric motor 30 through an interposed variable speed clutch 31, or by a variable speed motor. The centrifugal action of the blades 28 in the spinner separator acts on the fuel material projected upwardly into the blades 28 so that the oversized material will be centrifugally forced outwardly against the walls of the separator housing to fall back into the grinding chamber for further reduction. The material which is not returned to the grinding chamber 16 will pass outwardly through the outlet 32 and into conduit 33 connected into the suction side of blower 34. The outlet conduit 35 from the blower 34 delivers the air transported fuel material into a suitable burner indicated generally at 36 wherein the fuel is consumed and used to produce steam.

In the view of FIG. 1, the blower 34 is disposed on the outlet side of the mill, but it may just as well be located in conduit 21 to positively supply air to the mill.

Figure 2:
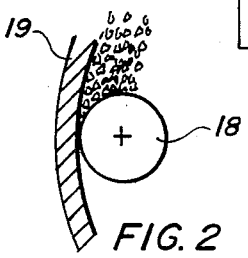
FIG. 2 is a fragmentary plan view illustrating an operating condition in the mill of FIG. 1 with an excessively thin depth of the fuel between the grinding roll and its bull ring.
Figure 4:
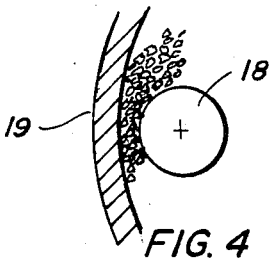
FIG. 4 is yet another view which illustrates an optimum depth of fuel in the mill.
Figure 3:
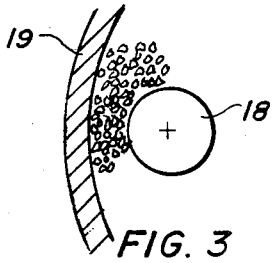
FIG. 3 is a view similar to FIG. 2 to illustrate a fuel depth that is too great.

The diagrams of FIGS. 2, 3 and 4, when considered collectively, show that there is an optimum fuel bed depth of material for the efficient grinding action of the rollers in response to the centrifugal force acting thereon so as to result in a desired reduction of the fuel material. The condition illustrated in FIG. 2 shows that the fuel bed depth is too thin to result in efficient crushing or breaking of the fuel particles, and there is a chance that the crushing roll may work into metal-to-metal contact with the bull ring. When this contact is experienced there will result a loss of capacity in the grinding of the fuel and a decrease in the efficiency of energy usage. In FIG. 3, the condition shown illustrates a fuel bed depth that is too deep for maximizing the centrifugal crushing force imparted on the fuel particles by the rolls. When the bed depth is too deep the result is a low energy efficiency and the grinding capacity will drop. The view of FIG. 4 is intended to illustrate an optimum or near optimum fuel bed depth between the crushing roll and the bull ring. In practice it is necessary for the apparatus to run under optimum conditions for maximum production of ground fuel at the most efficient use of energy. The controller 37 is operated to sample the signal inputs at selected intervals and determine if the mill 17 is operating efficiently at an optimum fluid bed depth that produces the ground fuel at the rate demanded by the burner and received from the feeder conveyor 9.

The controller 37 performs its function in response to signals transmitted by lead 39 from a fuel demand responsive transmitter 40 located at the burner 36. The controller 37 contemplated possesses a programmable character such as a Motorola M 6809 Micro Computer or an equivalent. The controller sends a signal to the motor 13 at feeder conveyor 9 through lead 38 and receives back a signal through lead 15 that the conveyor motor 13 is at a required speed to deliver fuel material at a pounds per hour rate which is calculated by the controller 37 so as to exactly match burner demand.

The controller 37 is effective to regulate the temperature of the incoming air in conduit 21 by the temperature responsive device 62 generating a signal in lead 63 which the controller 37 is able to modulate by transmitting a signal in lead 64 to the motor means 65 for damper 66 in the hot air return from the boiler associated with the burner 36, and by a signal in lead 67 to the motor means 68 for damper 69 in the inlet 21A for tempering air. These signals are generated in cooperation with an air velocity responsive Pitot tube 70 which is connected by lead 71 to the controller. Thus, blower 34 can deliver air at a minimum of 3500 SCFM and more as required to maintain a ratio of about 2.7 pounds of air per pound of fuel. It is also necessary that the controller 37 respond to information concerning the differential pressure across the mill and classifier. This is accomplished by a manometer device 43 which receives signals by lead 44 from a pressure responsive device 45 in the air inlet 21 and by lead 46 from a pressure responsive device 47 in the classifier 27. The manometer device 43 responds to the difference in the signals received from leads 44 and 46 and generates a differential pressure signal in lead 48 which is processed by the controller 37 in a manner to be described. It can be seen in FIG. 1 that the controller 37 is connected by lead 49 to a branch lead 50 and a branch lead 51, which leads are connected to the mill drive clutch 25 and the spinner clutch 31 respectively so these devices can be operated in inverse speed ranges. Also, it is seen in FIG. 1 that the controller is provided with a kilowatt hour meter 52 connected by lead 53 to the mill driving motor 26 for measuring the power consumption of that motor.

Figure 5:
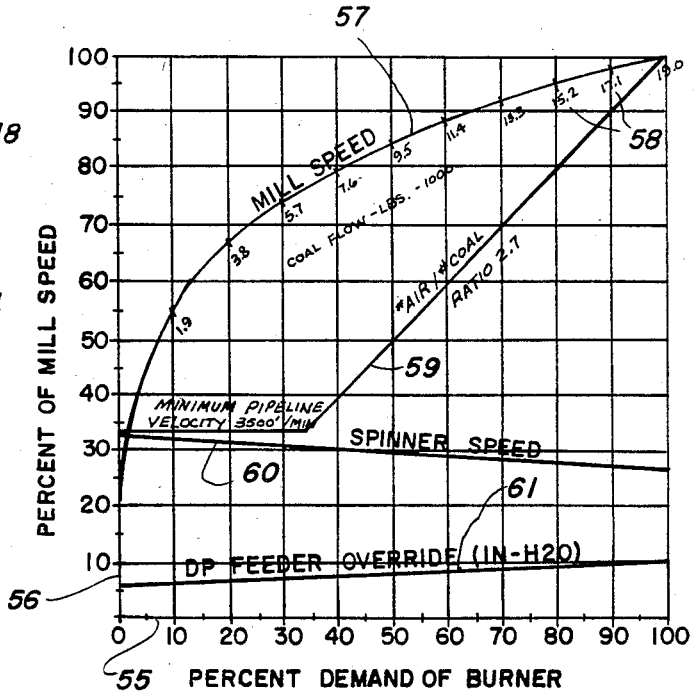
FIG. 5 is a graph illustrating certain desired relationships of mill speed, burner demand, classifier speed and differential pressure across the mill and classifier.

Turning now to FIG. 5, the graph illustrates important relationships between the several components of apparatus which need to be accounted for to make the system of this invention attain its objectives. The graph sets forth along its abscissa 55 the percentage of burner demand for fuel to produce the steam flow called for. The ordinate 56 sets forth the percent of mill speed for grinding the fuel material supplied from the feeder 9. The mill grinding speed curve 57 is translated into its ability to grind to a desired particle size and deliver into the conduit 33 quantities of the fuel material expressed by the values 58 along the curve 57 in pounds of fuel material increased by a factor 1000 for a typical system. Thus, at a burner demand of 70 percent of full capacity, the feeder 9 must deliver $13.3 \times 1000$ pounds of fuel material to be ground in the mill 17 at a mill speed about 91 percent of full speed which is the fourth power of 70 percent. At the same time, the blower 34 must be delivering air at the ratio of 2.7 pounds of air per pound of fuel material which is illustrated by the curve 59 into 35,910 pounds of air per hour, or about 7980 S.C.F.M. In this relationship the mill speed varies as the fourth power of the percentage of the burner demand for the fuel material. Concurrently, the spinner 27 will operate at a speed of about 27 percent of the spinner full speed which value is picked off of the curve 60 and will maintain constant product particle size.

During the operation of the foregoing system, and with the mill being able to grind the fuel material efficiently and within the burner demand and the ability of the feeder to meet the burner demand, the controller 37 will merely note that the differential pressure, or delta P, is at a value less than that expressed along the curve 61, for the corresponding burner demand. However, should a malfunction occur, such as a grinding roll 18 experiencing bearing failure resulting in a substantial drop in grinding capability, therefore the delta P value across the mill and spinner will begin to climb as there is now a mismatch between grinding rate and feed rate. The mismatch produces a change in the delta P value from the permissible readings of curve 61. When the delta P value rises above the curve 61 immediately, the controller 37 will operate an annunciator 72 to alert the operator of the existence of a malfunction so that corrections can be made. The monitoring of the delta P values by the controller 37 is relied upon as a safety net to safeguard the system by signalling a too high delta P and avoid costly repairs, or to indicate that the supply of fuel material from the feeder 9 to the mill has built up a fuel bed that is excessively thick, as depicted in FIG. 3, which the mill cannot grind efficiently or fast enough. The excessive fuel in the mill bed will cause the controller to either (a) slow the feeder 9, or (b) speed up the mill.

The foregoing details of the disclosed embodiment of the present invention is concerned with a method of controlling the operation of a centrifugally swung roller grinding mill which is connected with a burner so that the steam flow produced by burner will match the demand by properly regulating the supply of fuel material to the grinding mill so that the output will supply the amount of fuel demanded by the boiler so as to result in a required steam flow. In such a method, it is important to be able to adjust the rate of feed of the fuel to the roller grinding mill such that the grinding rolls are able to efficiently grind and reduce the fuel material without operating in a condition where the bed of fuel material in the grinding chamber is neither too thin nor too thick, but is at a depth where the centrifugal force exerted by the grinding rollers on the fuel material is able to result in an efficient reduction in the fuel material before it is transported by carrier air flow to the burner.

In its broad aspects the method includes feeding fuel material to the inlet of a centrifugally swung roller grinding mill in such quantities as to exactly match the burner fuel demand, driving the roller grinding mill at a speed which varies as the fourth power of the percentage of burner demand for fuel so as to substantially match the mill grinding capabilities with variations in the percentage of the burner fuel demand, supplying air through the grinding mill for transporting the ground fuel to the burner at a substantially constant ratio of air to fuel from a minimum air velocity which maintains the ground fuel moving in the air stream, monitoring the pressure differential across the roller mill between its air supply and its air transported outlet for detecting abnormal changes in the differential pressure as a safety net. In the foregoing method it is important to utilize the differential pressure across the roller grinding mill and its spinner separator independently relative to the burner demand as a safety net so as to be able to monitor the condition of the fuel fluid bed in the grinding chamber, whereby the development of a too thin or too deep fuel bed under the grinding rollers can be indicated merely be detecting significant changes in the pressure differential for any given burner demand. At such time as a change is detected a signal notice is sounded to the operator that something is wrong, and the response is either reduce the feed rate or adjust the mill grinding rate.

The foregoing specification has set forth a preferred embodiment of apparatus for practicing the method of this invention, and it is to be understood that variations in the components of the embodiment may become apparent without substantially deviating from the scope of the method.

What is claimed is:

1. A method of operating a variable speed fuel grinding roller mill having centrifugally responsive rollers, the mill being connected to a burner for consuming ground fuel and also connected to an air supply for supporting fuel combustion by the burner, said method comprising the steps of:

(a) providing a fuel demand signal transmitter responsive to a burner demand for fuel;

(b) providing a variable fuel feeder connected to the roller mill, thereby establishing a fuel bed in the mill;

(c) supplying combustion supporting air through the fuel bed in the roller mill, thereby transporting ground fuel to the burner and establishing a predetermined differential pressure across the roller mill;

(d) synchronizing feeding of fuel to the roller mill in accordance with a burner demand for fuel;

(e) sensing energy consumption of the centrifugally responsive rollers, and sensing the differential pressure across the roller mill;

(f) monitoring the sensed energy consumption of the centrifugally responsive rollers, and monitoring the sensed differential pressure across the roller mill; and (g) adjusting a depth of the fuel bed in the roller mill independently of the burner demand for fuel, and adjusting the depth of the fuel bed in response to the sensed energy consumption of the centrifugally responsive rollers.

2. The method set forth in claim 1 wherein adjusting the depth of the fuel bed in the roller mill is accomplished by changing the sensed differential pressure and adjusting an amount of fuel that is fed to the mill, thereby maintaining the change in the sensed differential pressure while maintaining a speed of the centrifugally responsive rollers, thereby retaining optimum consumption of energy by the roller mill.

3. The method set forth in claim 1 wherein adjusting the depth of fuel in the roller mill is accomplished by changing the sensed differential pressure and adjusting of the centrifugally responsive rollers while holding a fuel feeding rate constant, thereby maintaining the changed differential pressure, and thereby obtaining the optimum consumption of energy by the roller mill.

4. The method set forth in claim 1, further including the step of varying a feed rate of fuel and varying a speed of the centrifugally responsive rollers relative to each other to, thereby effecting a differential pressure condition in the roller mill, and thereby obtaining an optimum consumption of energy by the roller mill.

* * * * *

UNITED STATES PATENT AND TRADEMARK OFFICE

CERTIFICATE OF CORRECTION

PATENT NO. : 4,602,744

DATED : July 29, 1986

INVENTOR(S) : Robert M. Williams

It is certified that error appears in the above-identified patent and that said Letters Patent is hereby corrected as shown below:

Column 1, line 42, "as" should be "a".

Column 6, line 51, the word "and" should be inserted before "thereby".

Column 6, line 55, the word "speed" should be inserted after "adjusting".

Column 6, line 58, the word "the" should be omitted.

Column 6, line 63, the word "to" should be omitted.

Signed and Sealed this

Seventh Day of October, 1986

[SEAL]

*Attest:*

DONALD J. QUIGG

*Attesting Officer*

*Commissioner of Patents and Trademarks*